US005947620A

United States Patent [19]

Kageyama et al.

[11] Patent Number: 5,947,620

[45] Date of Patent: Sep. 7, 1999

[54] DOUBLE-CHUCK MECHANICAL PENCIL

[75] Inventors: Hidehei Kageyama; Shouji Anzai; Tadashi Yamamoto; Yoshihide Mitsuya, all of Kawagoe, Japan

[73] Assignee: Kotobuki & Co., Ltd., Kyoto, Japan

[21] Appl. No.: 08/563,100

[22] Filed: Nov. 27, 1995

[30] Foreign Application Priority Data

Dec. 7, 1994 [JP] Japan ..... 6-330317
Aug. 22, 1995 [JP] Japan ..... 7-234634

[51] Int. Cl.[6] ..... B43K 21/22
[52] U.S. Cl. ..... 401/67; 401/65
[58] Field of Search ..... 401/67, 65

[56] References Cited

U.S. PATENT DOCUMENTS

| | | | |
|---|---|---|---|
| 2,203,160 | 6/1940 | Kovacs | 401/67 |
| 3,814,524 | 6/1974 | Sperti | 401/67 X |
| 4,165,941 | 8/1979 | Kageyama et al. | 401/67 X |
| 4,627,756 | 12/1986 | Kageyama | 401/67 X |
| 5,009,533 | 4/1991 | Kageyama | 401/65 |

FOREIGN PATENT DOCUMENTS

| | | | |
|---|---|---|---|
| 170153 | 1/1952 | Austria | 401/67 |
| 683616 | 10/1939 | Germany | 401/67 |
| 696120 | 9/1940 | Germany | 401/67 |
| 186296 | 9/1936 | Switzerland | 401/67 |
| 833345 | 4/1960 | United Kingdom | 401/67 |

*Primary Examiner*—Steven A. Bratlie
*Attorney, Agent, or Firm*—Rothwell, Figg, Ernst & Kurz

[57] ABSTRACT

A double-chuck mechanical pencil comprises: a barrel; a barrel cap attached to the barrel; a lead tank axially slidably inserted in the barrel; a back chuck fixedly joined to the front end of the lead tank; a chuck ring loosely fitted on the chucking head of the back chuck; a tubular member disposed so as to surround the front portion of the lead tank; a back elastic member placed in the tubular member so as to bias the lead tank backward; a coupling member combined with the tubular member, and provided in its inner circumference with stopping portions with which the tubular member and the chuck ring come into contact, respectively; a front chuck fixedly joined to the front portion of the coupling member; and a front elastic member interposed between the barrel cap and the coupling member so as to bias the coupling member backward. A rotation prohibitor permits the axial movement of the coupling member and prohibits the rotation of the same relative to the tubular member. A tail cap is attached to the back end of the barrel and a push cap is detachably put on the back end of the lead tank. Another rotation prohibitor permits the axial movement of the push cap and prohibits the rotation of the same relative to the tail cap.

4 Claims, 15 Drawing Sheets

DOUBLE-CHUCK MECHANICAL PENCIL

BACKGROUND OF THE INVENTION

1. Field of the Invention

The present invention relates to a double-chuck mechanical pencil provided with a front chuck and a back chuck and, more particularly, to a double-chuck mechanical pencil provided with a front chuck for restraining the lead from retracting and a back chuck for extruding the lead, loosely fitted in a chuck ring.

2. Description of the Prior Art

Referring to FIG. 1 showing a known push-button double-chuck mechanical pencil provided with two chucks intended to reduce the residual lead, proposed in Japanese Patent Laid-open No. Sho 54-119435, a barrel cap a is attached to the front end of a barrel b, a back chuck d for extruding the lead by a predetermined length at a time is inserted in the barrel b and is biased backward by a spring c, and a front chuck e for gripping the lead is fitted in the cap a and is biased backward by a spring f. The back chuck d is advanced to feed the lead. After feeding the lead by a predetermined length, the back chuck d is unfastened and is further advanced by a predetermined distance necessary for pushing the front chuck e at the rear end so that the front chuck e opens. When the barrel cap a is removed from the barrel b in a state where no lead is held by the front chuck e, there is a possibility that the front chuck e slips off the barrel cap a. When the front chuck e is pushed to open by the back chuck d, the lead is caused to slip out of the front chuck e by its own weight.

Although various double-chuck mechanical pencils of this kind principally designed to reduce the residual lead have been proposed, these previously proposed double-chuck mechanical pencils are complex in construction and difficult to assemble and disassemble. Furthermore, in those previously proposed double-chuck mechanical pencils, if one of the two chucks is turned due to some cause while both the chucks are gripping the lead, the lead is twisted to break, a broken piece of the lead remains between the two chucks to obstruct the feed of the lead, and back end of the front portion of the lead and the front end of the back portion of the lead are unable to engage properly, making the extrusion of the following lead impossible.

For example, in a mechanical pencil having a coupling member screwed on a barrel, if the coupling member turns when separating the barrel from the coupling member to remove a broken piece of the lead, the back chuck is turned, the back portion of the lead gripped by the back chuck is twisted relative to the front portion of the lead gripped by the front chuck and, consequently, the lead is broken. If the user turns unintentionally the push button or the eraser holder connected through a lead tank to the back chuck, the back chuck is turned together with the lead tank, a back portion of the lead gripped by the back chuck is turned relative to a front portion of the lead gripped by the front chuck and, consequently, the lead is broken.

SUMMARY OF THE INVENTION

Accordingly, it is an object of the present invention to provide a double-chuck mechanical pencil having a front chuck which will not slip off a barrel cap, even if the barrel cap is removed from a barrel when the front chuck is not gripping any lead.

Another object of the present invention is to provide a double-chuck mechanical pencil provided with a front chuck and a back chuck which are allowed to move axially and restrained from turning by a detaining means to prevent breaking the lead, having internal parts that will not slip off the barrel when the barrel cap is removed from the barrel to remove a broken lead, and capable of being easily assembled.

BRIEF DESCRIPTION OF THE DRAWINGS

The above and other objects, features and advantages of the present invention will become more apparent from the following description taken in connection with the accompanying drawings, in which.

DETAILED DESCRIPTION OF THE PREFERRED EMBODIMENTS

Figure 1:
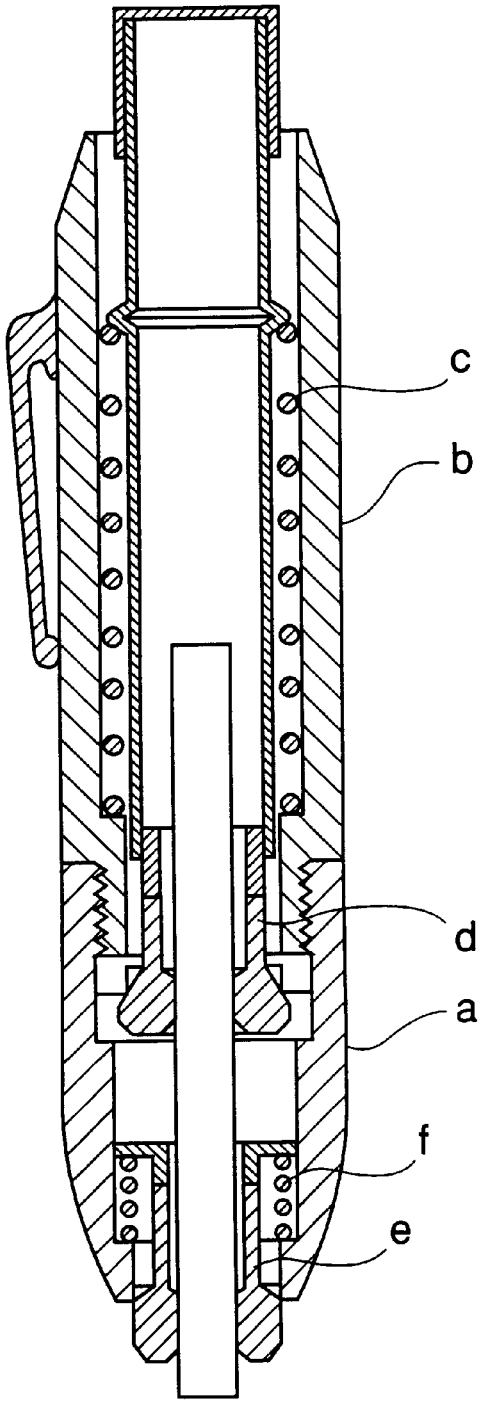
FIG.1 PRIOR ART
FIG. 1 is a longitudinal sectional view of a prior art double-chuck mechanical pencil.
Figure 2:
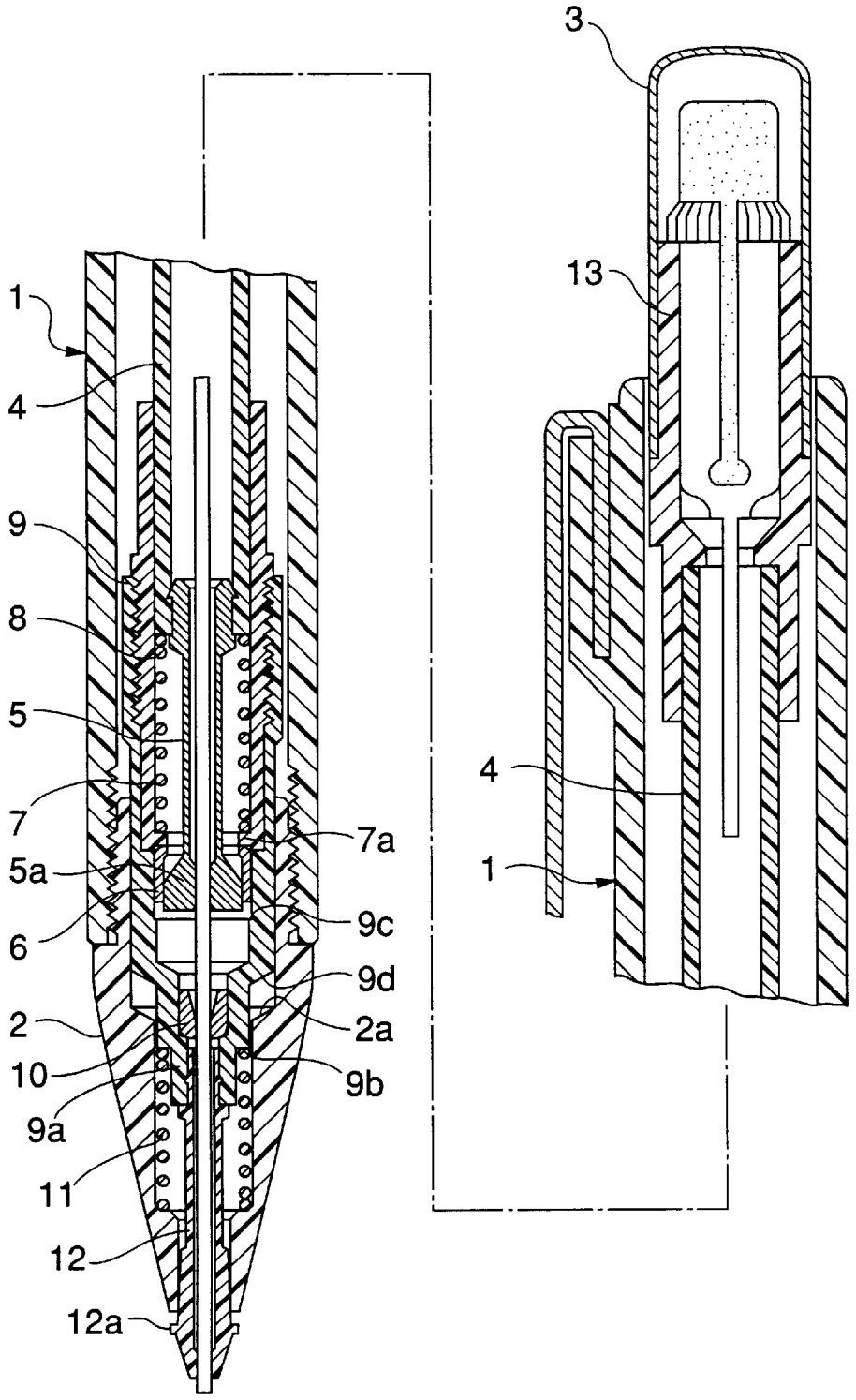
FIG. 2 is a longitudinal sectional view, partly omitted, of a double-chuck mechanical pencil in a first embodiment according to the present invention.
Figure 3:
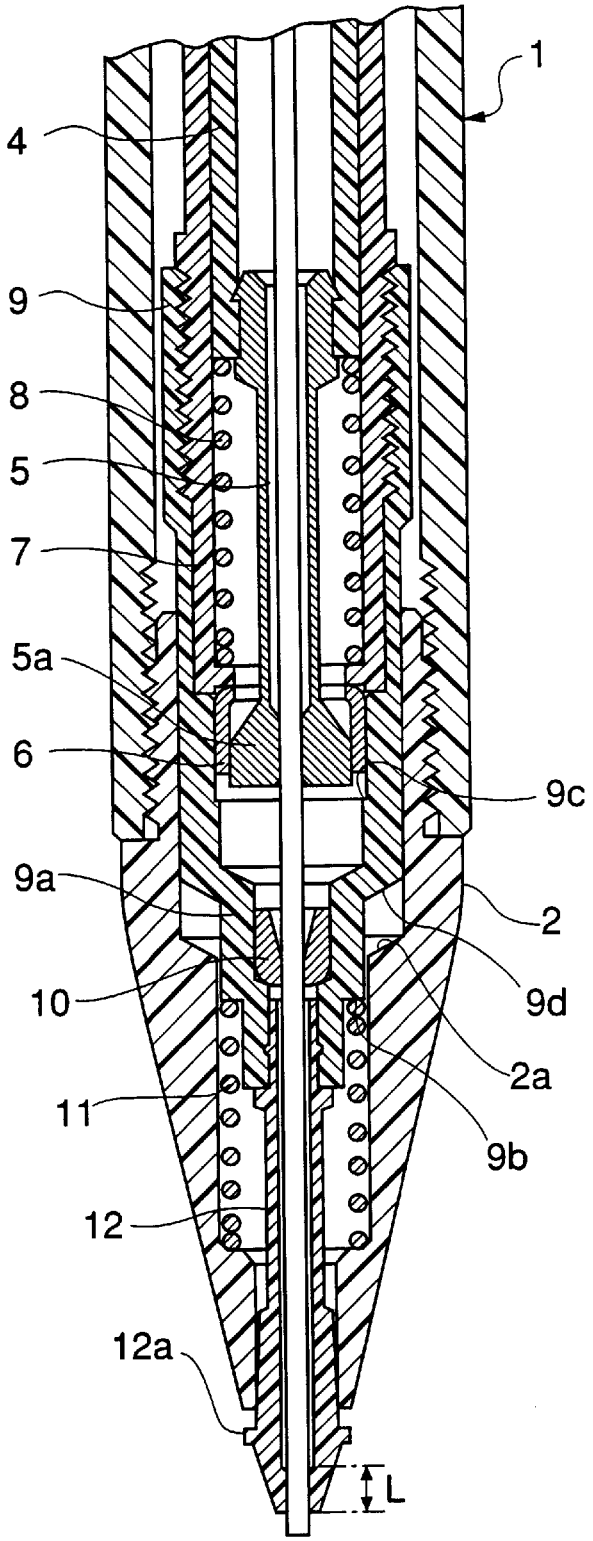
FIG. 3 is an enlarged longitudinal sectional view of an essential portion of the double-chuck mechanical pencil of FIG. 2.

Referring to FIGS. 2 and 3 showing a double-chuck mechanical pencil in a first embodiment according to the present invention, a barrel cap 2 is screwed on the front end of a barrel 1, a push cap 3 is detachably fitted in the rear end of the barrel 1, a lead tank 4 provided with an eraser holder 13 on its rear end is axially slidably inserted in the barrel 1, the back portion of a back chuck 5 is fixedly pressed in the front end of the lead tank 4, and a chuck ring 6 is loosely fitted on the chucking head 5*a* of the back chuck 5. A back spring 8 is extended between an inside flange 7*a* formed at the front end of a tube 7 and contiguous with the back end of the chuck ring 6, and the front end of the lead tank 4 in the tube 7. A coupling member 9 having a reduced front portion 9*a* is screwed on the tube 7, and a frictional member 10, such as a rubber ring, for frictionally holding the lead is fitted in the reduced front portion 9*a*. A front spring 11 is extended between a shoulder formed in the reduced front portion 9*a* and a shoulder formed in the inner surface of a barrel cap 2 so as to bias the coupling member 9 backward. In this embodiment, the resilience of the front spring 11 is lower than that of the back spring 8 in view of operability. A front chuck 12 for holding the lead is fixedly pressed in the front end 9*b* of the reduced front portion 9*a* of the coupling member 9.

Whereas the front portion of the back chuck 5 is slit and radially expanded, the front portion of the front chuck 12 is merely slit. The front chuck 12 is formed so as to grip the lead lightly to prohibit the free movement of the lead and to allow the axial movement of the lead when some axial force acts on the lead when the front chuck 12 is at an advanced position, and to grip the lead firmly so that the lead may not be pushed back by a writing pressure acting on the lead during writing when the front chuck 12 is at a retracted position. The front chuck 12 is provided with a stopping projection 12*a* in a portion thereof projecting outside from the extremity of the barrel cap 2. The slit front portion of the front chuck 12 is expanded and the stopping projection 12*a* is separated from the extremity of the barrel cap 2 when the lead is held by the front chuck 12 as shown in FIG. 2. When the lead is removed from the front chuck 12, the slit front portion of the front chuck 12 contracts and the front chuck 12 is retracted. However, stopping projection 12*a* limits the excessive retraction of the front chuck 12, so that the front chuck 12 will not slip off the barrel cap 2 and will not be lost.

When using the double-chuck mechanical pencil for writing, the push cap 3 fitted in the back end of the barrel 1 is pushed. Since the resilience of the front spring 11 is lower than that of the back spring 8, first the front spring 11 is compressed, the front chuck 12 is advanced and, consequently, the slit front portion of the front chuck expands to receive the lead in the front chuck 12. As the push cap 3 is pushed further, a shoulder 9*d* of the coupling member 9 comes into contact with a step 2*a* formed in the barrel cap 2, the back spring 8 is compressed and the back chuck 9 is advanced together with the lead tank 4. As the back chuck 5 is advanced, the chuck ring 6 is stopped by a step 9*c* formed in the coupling member 9, the slit chucking head 5*a* of the back chuck 5 is allowed to expand and, consequently, the lead is caused to drop by gravity to and held by the frictional member 10. Then, the back chuck 5 is returned to the initial position and grips the lead when the push cap 3 is released. When the push cap 3 is pushed again, the back chuck 5 gripping the lead is advanced through the reduced front portion 9*a* of the coupling member 9 to feed the lead and, consequently, the lead is advanced through the front chuck 12 and is extruded from the barrel cap 2. When the lead is abraded during writing, the push cap 3 is pushed to feed the lead. When the lead wears short, the operation for pushing the push cap 3 is repeated to feed a new lead from the lead tank 4 and to push out the worn lead for continuous writing. Therefore, only a small length L (FIG. 3) of the lead is wasted. If an excessively large length of the lead is extruded from the front end of the front chuck 12, the push cap 3 is pushed to open the chucking head 5*a* of the back chuck 5, and the lead is pushed back into the front chuck 12 so that an appropriate length of the lead is projected from the tip of the front chuck 12 to prevent the breakage of the lead.

Figure 4:
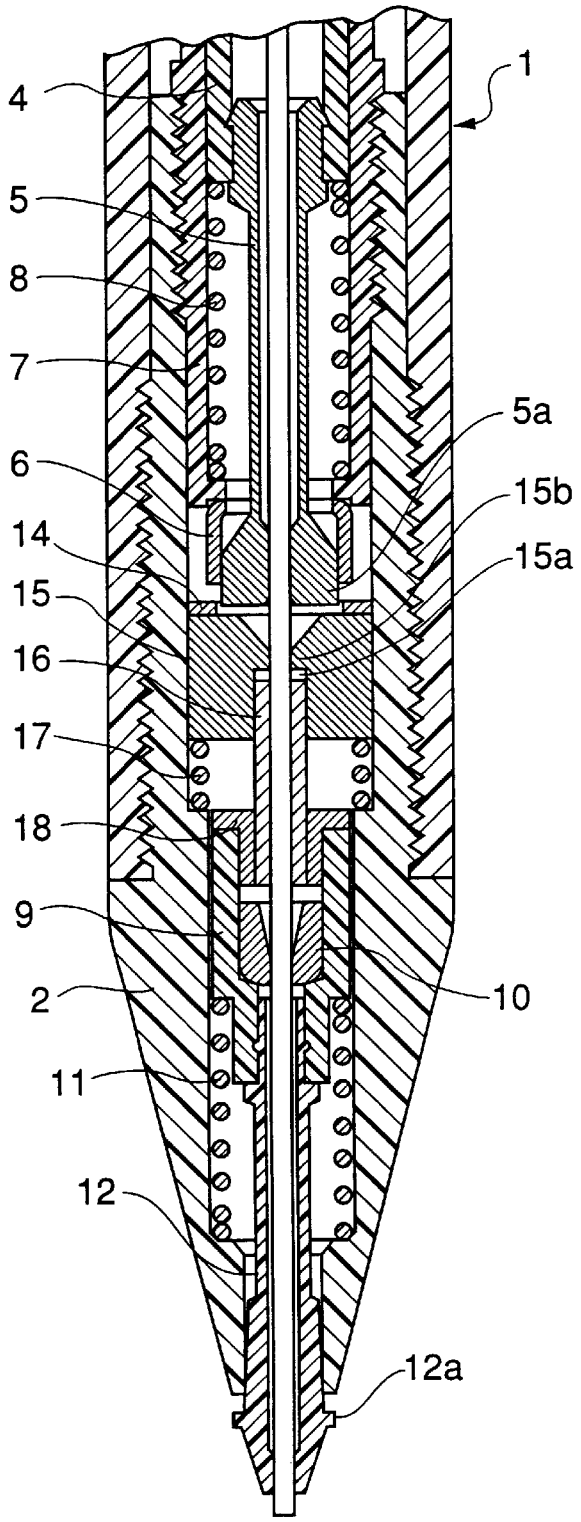
FIG. 4 is a fragmentary longitudinal sectional view of a double-chuck mechanical pencil in a second embodiment according to the present invention.

FIG. 4 shows a double-chuck mechanical pencil in a second embodiment according to the present invention formed by incorporating improvements into the double-chuck mechanical pencil in the first embodiment. The double-chuck mechanical pencil in the second embodiment is similar in construction to the double-chuck mechanical pencil in the first embodiment and hence only components, mechanisms and functions of the double-chuck mechanical pencil in the second embodiment different from those of the double-chuck mechanical pencil in the first embodiment will be described. As shown in FIG. 4, a lead path between a back chuck 5 and the front end of a front chuck 12 is substantially entirely covered to prevent the breakage of the lead by shocks when the lead drops. The back chuck 5 and the front chuck 12 are not directly interlocked. A fixed ring 14 is disposed in the back portion of a barrel cap 2 to use the fixed ring 14 as a stopper for stopping a chuck ring 6. A stopping tube 15 is disposed on the front side of the fixed ring 14, and a guide pipe 16 is axially slidably fitted in a hole formed in the stopping tube 15 so that a gap 15*a* is formed between the bottom of the hole of the stopping tube 15 and the back end of the guide pipe 16. An intermediate spring 17 is extended between the front end of the stopping tube 15 and a step formed in the inner surface of the barrel cap 2. The front portion of the guide pipe 16 is fitted in a bush 18 fitted in a coupling member 9. A frictional member 10 for frictionally holding the lead is fitted in the coupling member 9. The back portion of the front chuck 12 is fixedly pressed in the front portion of the coupling member 9. Since the back chuck 5 and the front chuck 12 are not directly interlocked, any particular consideration need not be given to the relation in resilience between a back spring 8 and a front spring 11.

When using the double-chuck mechanical pencil for writing, a push cap 3 (FIG. 2) fitted in the back end of a barrel 1 is pushed to advance the back chuck 5 together with a lead tank 4. As the back chuck 5 is advanced, a chuck ring 6 comes into contact with the back end of the fixed ring 14 and is stopped to allow the chucking head 5*a* of the back chuck 5 to expand. As the back chuck 5 is further advanced, the front end of the back chuck 5 comes into contact with the back end of the stopping tube 15 and pushes the stopping tube 15, the inner ridge 15*b* of the stopping tube 15 comes into contact with the back end of the guide pipe 16 and pushes the guide pipe 16 forward, compressing the intermediate spring 17. Since the guide pipe 16 is connected to the coupling member 9 by the bush 18, the coupling member 9 is advanced as the guide pipe 16 advances. Consequently, the front chuck 12 fixedly fitted in the front portion of the coupling member 9 is advanced and allowed to open to extrude the lead. When the push cap 3 is released, the front chuck 12 is retracted as far as a stopping projection 12*a* formed on the front portion of the front chuck 12 comes into contact with the extremity of the barrel cap 2. Then, the front chuck 12 is closed to grip the lead firmly for writing. Since a gap 15*a* is formed between the inner ridge 15*b* and the back end of the guide pipe 16, the accidental opening of the front chuck 12 when the push cap 3 is not pushed due to dimensional errors in the parts can be prevented.

Figure 5:
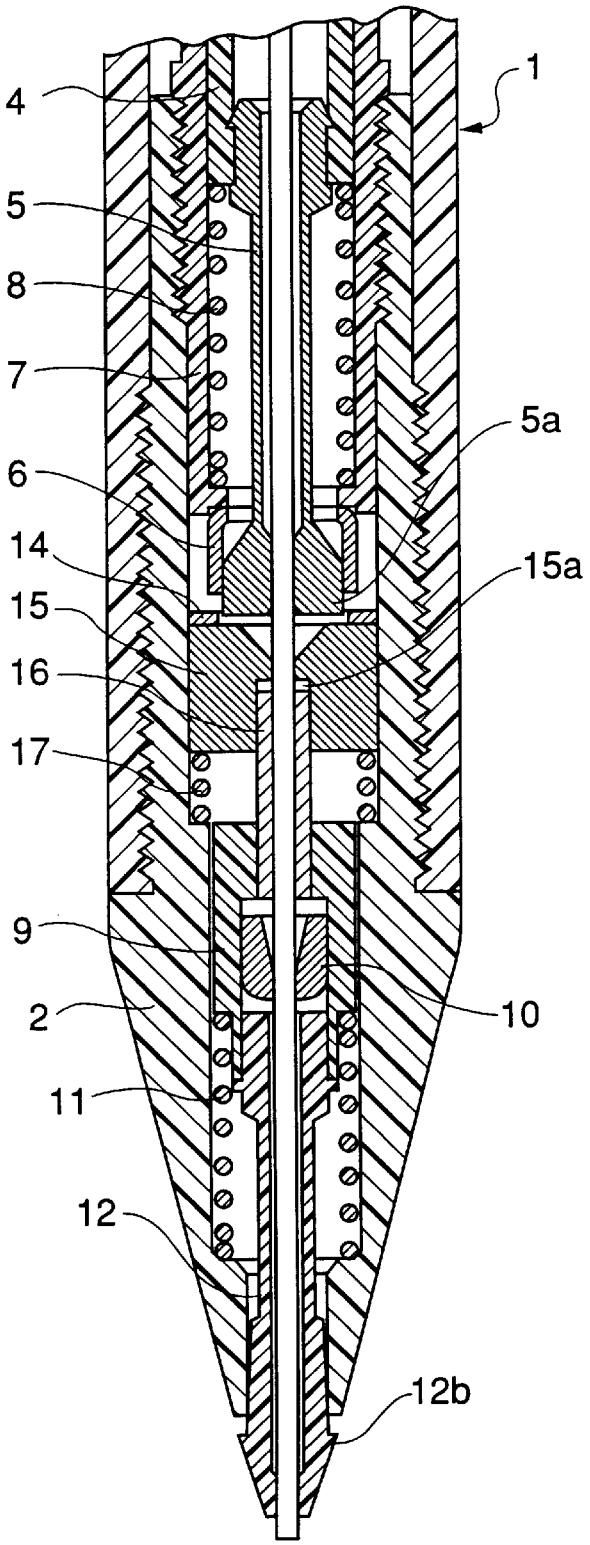
FIG. 5 is a fragmentary longitudinal sectional view of a modification of the double-chuck mechanical pencil of FIG. 4.

FIG. 5 shows a modification of the double-chuck mechanical pencil of FIG. 4. The double-chuck mechanical pencil shown in FIG. 5 is provided with a sleeve 19 serving as the stopping tube 15 and the bush 18 of the double-chuck mechanical pencil of FIG. 4. A front chuck 12 is provided with a step 12*b* instead of the stopping projection 12*a* of the double-chuck mechanical pencil of FIG. 4. The operation of this modification is entirely the same as that of the second embodiment.

Figure 6:
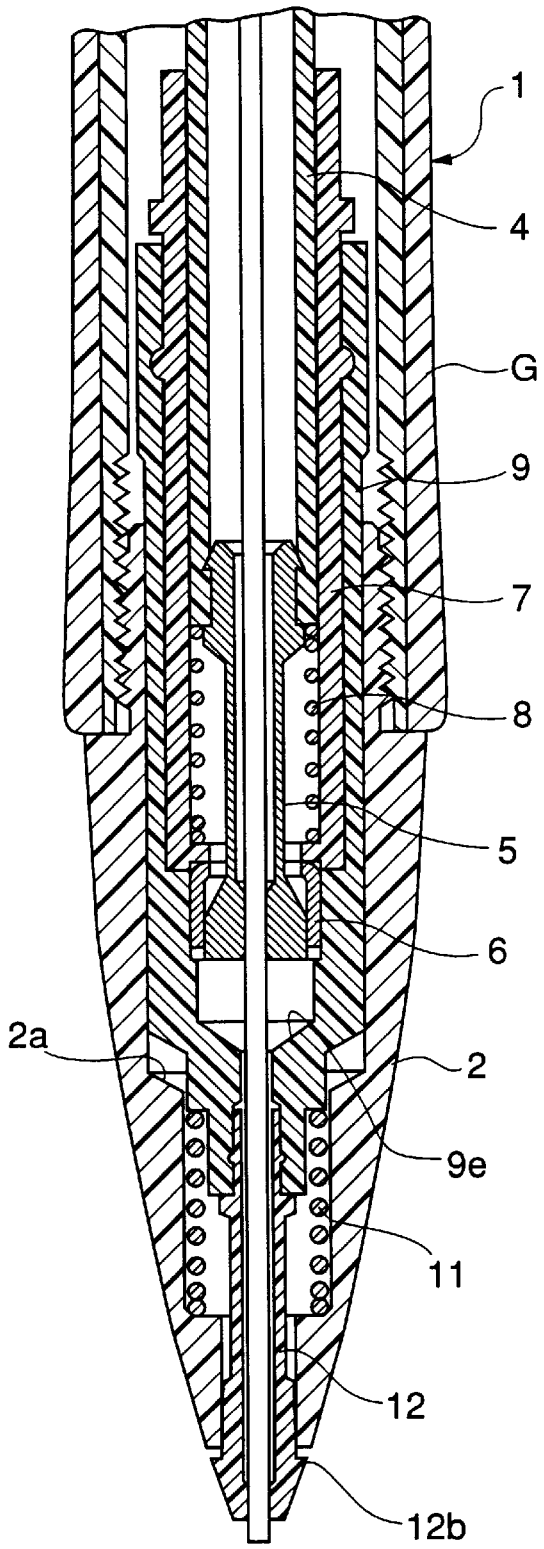
FIG. 6 is a fragmentary longitudinal sectional view of a double-chuck mechanical pencil in a third embodiment according to the present invention.

A double-chuck mechanical pencil in a third embodiment according to the present invention shown in FIG. 6 is substantially the same in construction as those in the foregoing embodiments. As shown in FIG. 6, this double-chuck mechanical pencil is not provided with any member corresponding to the frictional member 10 for holding the lead between a front chuck 12 and a back chuck 5 to reduce the number of the component parts and to simplify the construction, and needs less repetitions of the lead feeding operation to feed a lead from a lead tank 4 to the front end of the front chuck 12. The front end of the bore of a coupling member 9 is formed in a taper surface 9*e* tapered toward the front to guide the lead smoothly. A tube 7 and a coupling member 9 are engaged by fitting an circular ridge formed on the tube 7 in a circular groove formed in the inner surface of the coupling member 9. In FIG. 6, indicated at G is a nonslip grip member formed of rubber or a soft plastic material.

Since this double-chuck mechanical pencil is provided with no frictional member for holding the lead, the lead released from the back chuck 5 by pushing a push cap is caused to drop by gravity directly into the front chuck 12 which grips the lead lightly in a degree high enough to restrain the lead from slipping off the front chuck 12. Therefore, supposing that the pitch of feed of a 0.5 mm diameter lead for mechanical pencils is on the order of 0.7 mm, this double-chuck mechanical pencil needs less repetitions of the lead feeding operation than the double-chuck mechanical pencils provided with the frictional member, such as a rubber ring, to project the lead from the tip of the front chuck 12.

Figure 7:
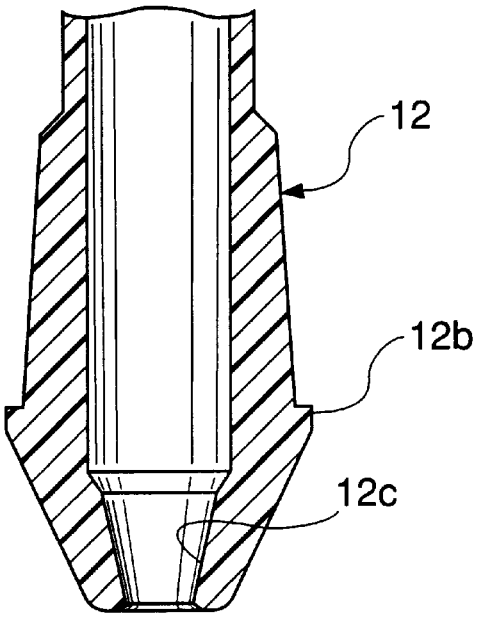
FIG. 7 is an enlarged longitudinal sectional view of a front portion of a front chuck included in the double-chuck mechanical pencil of FIG. 6.

FIG. 7 shows a front chuck 12 in accordance with the present invention. A taper hole 12*c* is formed in the front end of the bore of this front chuck 12 to further reduce the residual lead. The omission of the frictional member for holding the lead and the employment of this front chuck 12 reduces the pitch of feed instead of reducing the number of repetitions of the lead feeding operation so that the lead being used is advanced by the following lead at a reduced pitch of feed to reduce the residual lead to the least possible extent.

Figure 8:
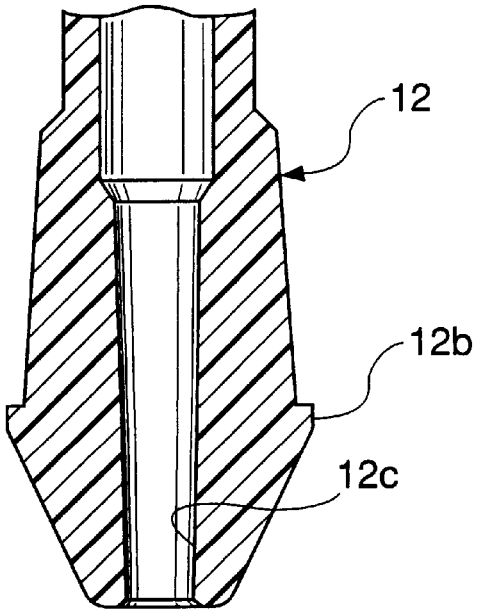
FIG. 8 is a modification of the front chuck of FIG. 7.

FIG. 8 shows a front chuck 12 in a modification of the front chuck 12 of FIG. 7. The taper hole 12*c* of the front chuck 12 of FIG. 8 is longer than the taper hole 12*c* of the front chuck 12 of FIG. 7 and extends from a position behind a stopping step 12*b* (or a stopping projection) to the tip of the front chuck 12. The cone angle of the taper hole 12*c* may be selectively determined taking into consideration the size of the front chuck 12 and the diameter of the lead.

Although the invention has been described as applied to push-cap type double-chuck mechanical pencils, the present invention is applicable also to side-push type double-chuck mechanical pencils and other push-cap type double-chuck mechanical pencils which need a turning operation.

Referring to FIGS. 9 to 13 showing a double-chuck mechanical pencil in a fourth embodiment according to the present invention, a barrel cap 2 is screwed in the front end of a barrel 1, a push cap 3 is detachably attached to the back end of a lead tank 4, the lead tank 4 is axially slidably inserted in the barrel 1, a back chuck 5 is fixedly pressed in the front end of the lead tank 4, and a chuck ring is loosely fitted on the chucking head 5*a* of the back chuck 5. An elastic tube 28 provided with an inner flange 28*a* at its front end is disposed in contact with the back end of the chuck ring 6, and a back spring 8 is extended between the inner flange 28*a* of the elastic tube 28 and the front end of the lead tank 4 to bias the lead tank 4 backward.

Figure 10:
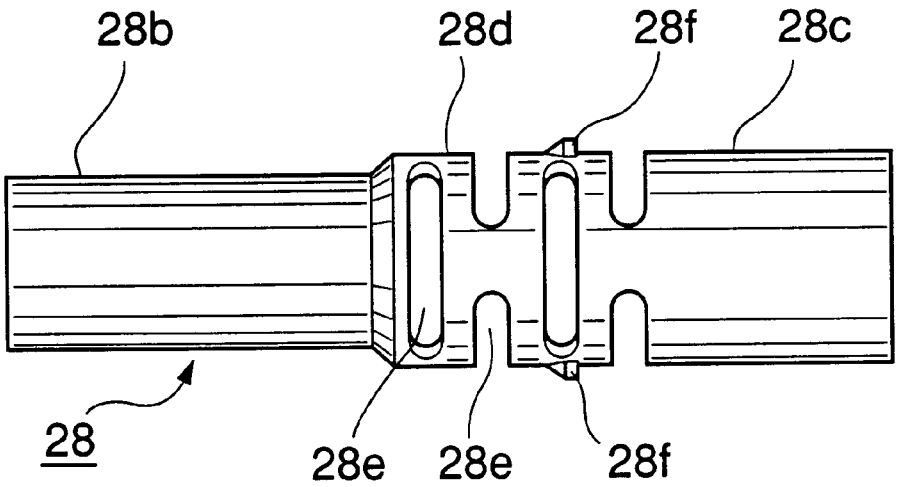
FIG. 10 is a front view of an elastic tube included in the double-chuck mechanical pencil of FIG. 9.
Figure 11:
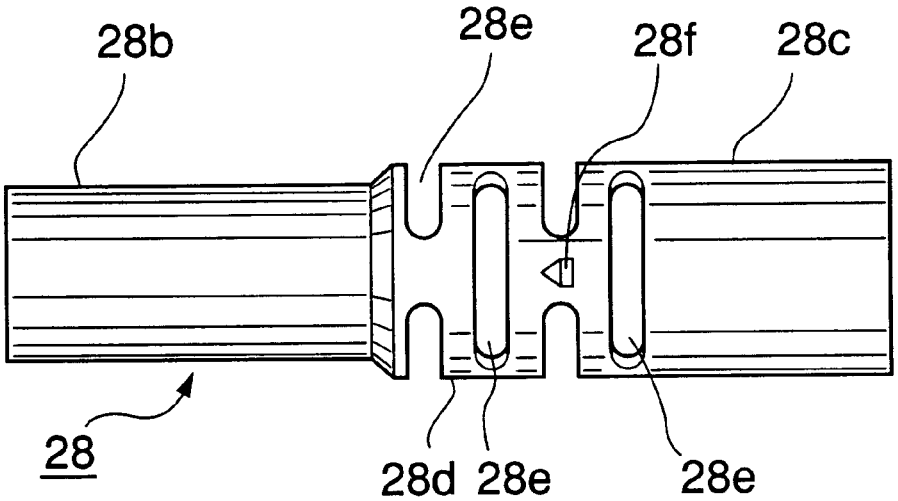
FIG. 11 is a front view of the elastic tube of FIG. 10.

Referring to FIGS. 10 and 11, the elastic tube 28 has a reduced front section 28*b*, an expanded back section 28*c*, and an elastic middle section 28*d* extending between the reduced front section 28*b* and the expanded back section 28*c*. The elastic tube has the function of a cush sleeve. A plurality of pairs of diametrically opposite slots 28*e* are formed in the elastic middle section 28*d* in a staggered arrangement so that the elastic middle section 28*d* is axially extendible and contractible. A pair of trapezoidal detaining protrusions 28*f* are formed on the outer surface of the elastic middle section 28*d* so as to engage with detaining openings 29*e* formed in a coupling member 29 when the elastic tube 28 is inserted in the coupling member 29.

Figure 12:
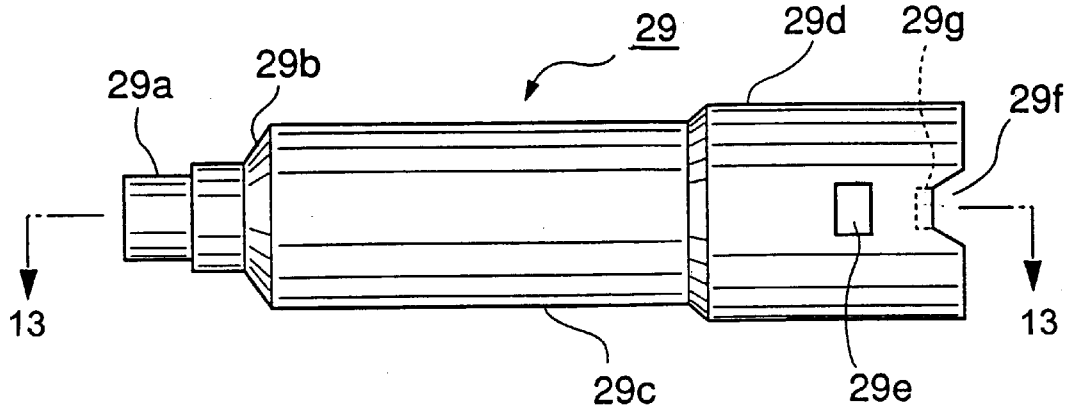
FIG. 12 is a front view of a coupling member included in the double-chuck mechanical pencil of FIG. 9.
Figure 13:
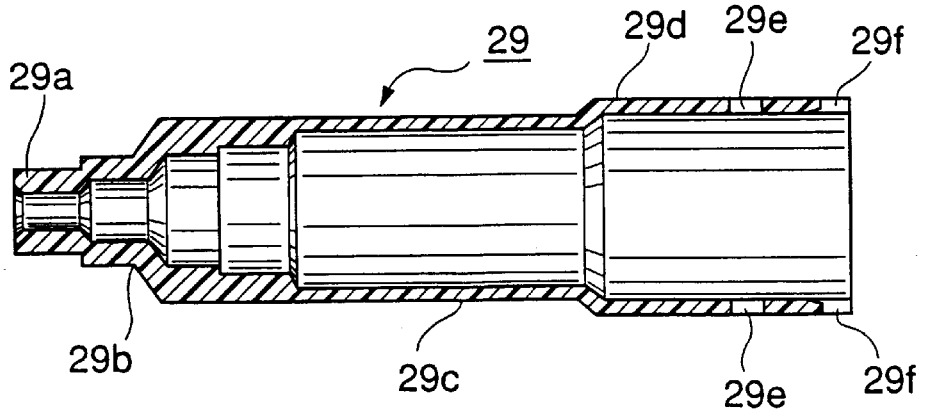
FIG. 13 is a sectional view taken on line A—A' in FIG. 12.

As shown in FIGS. 12 and 13, the coupling member 29 has a reduced front end section 29*a*, a tapered shoulder 29*b* formed behind the reduced front end section 29*a*, a middle section 29*c* extending behind the tapered shoulder 29*b*, and an expanded back section 29*d* extending behind the middle section 29*c*. The detaining openings 29*e* are formed in the wall of the expanded section 29*d*. Guide recesses 29*f* expanding toward the back are formed in line with the detaining openings 29*e* to guide the detaining protrusions 27*f* when inserting the elastic tube 28 in the coupling member 29. Guide grooves 29*g* formed in the inner surface of the expanded section 29*e* continuously with the guide recesses 29*f* as indicated by dotted lines further facilitates the insertion of the elastic tube 28 in the coupling member 29. A front spring 11 is extended between the extremity of the reduced front section 29*a* of the coupling member 29 and a step formed in the inner surface of the barrel cap 2 to bias the coupling member 29 backward. In view of operability, the resilience of the front spring 11 is lower than that of the back spring 8. A front chuck 12 for gripping the lead is fixedly pressed in the front end of the reduced front section 29*a* of the coupling member 29.

Figure 9:
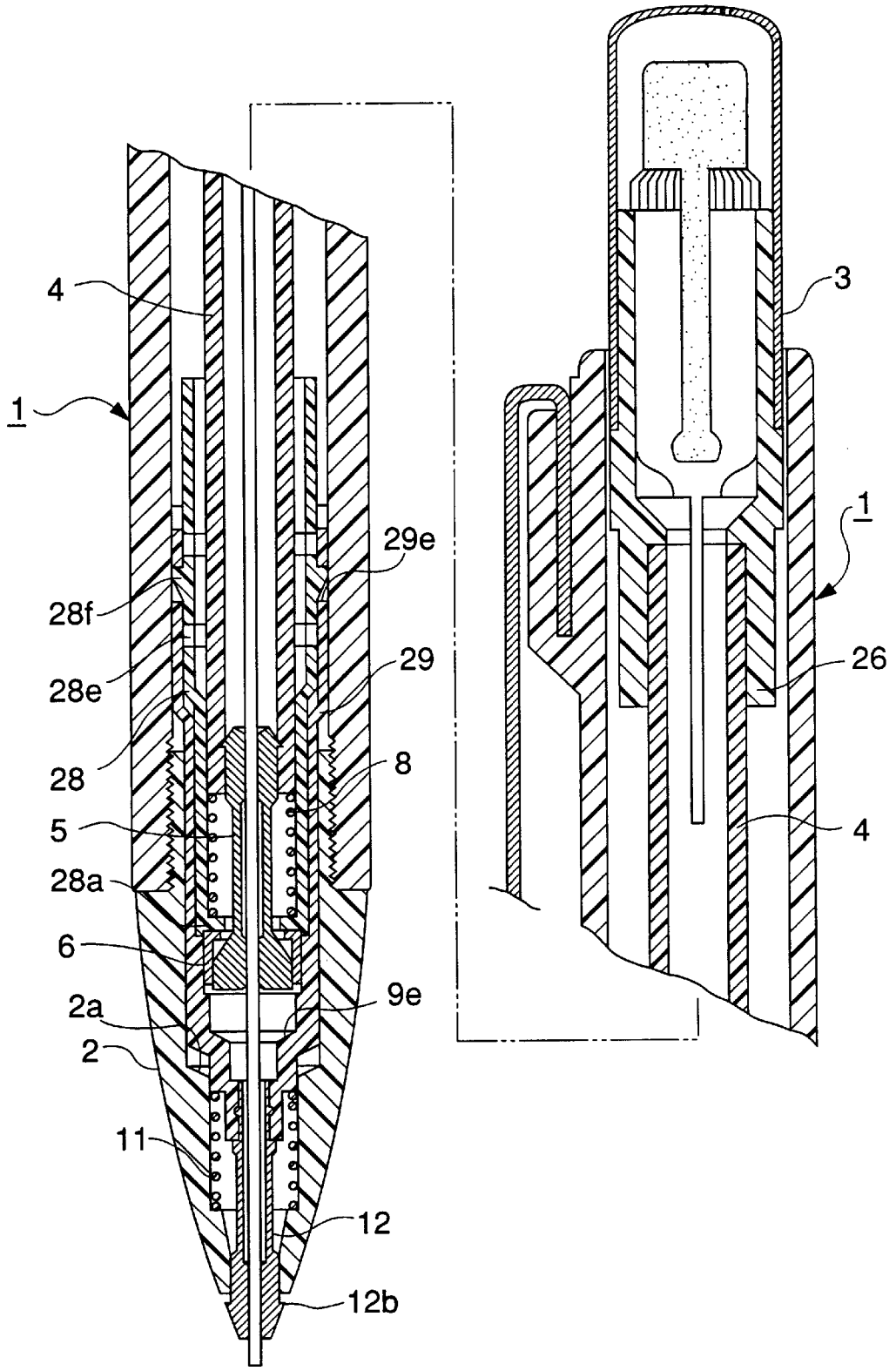
FIG. 9 is a longitudinal sectional view, partly omitted, of a double-chuck mechanical pencil in a fourth embodiment according to the present invention.

The chucking head of the back chuck 5 is formed by slitting and expanding the front portion of the back chuck 5, and the chucking head of the front chuck 12 is formed simply by slitting the front portion of the front chuck 12. When set in the barrel cap 2 and advanced, the front chuck 12 grips the lead lightly in a degree high enough to restrain the lead from slipping off the front chuck 12 and allows the lead to move when an axial force acts on the lead. When the front chuck 12 holding the lead is retracted, the chucking head of the front chuck 12 grips the lead firmly so that the lead cannot be pushed back by an axial force that acts on the lead while the double-chuck mechanical pencil is used for writing. The front chuck 12 is provided with a stopping step 12*b* in a portion thereof projecting outside from the extremity of the barrel cap 2. The slit chucking head of the front chuck 12 is expanded and the stopping step 12*b* is separated from the extremity of the barrel cap 2 when the lead is held by the front chuck 12 as shown in FIG. 9. When the lead is removed from the front chuck 12, the slit chucking head of the front chuck 12 contracts and the front chuck 12 is retracted. However, stopping step 12*b* limits the excessive retraction of the front chuck 12, so that the front chuck 12 will not slip off the barrel cap 2 and will not be lost.

When the push cap 3 is pushed to use the double-chuck mechanical pencil, first, the front spring 11 is compressed because the resilience of the front spring 11 is lower than that of the back spring 8, the front chuck 12 opens to be ready to receive the lead, the tapered shoulder 29*b* of the coupling member 29 comes into contact with a step 2*a* formed in the inner surface of the barrel cap 2 and, subsequently, the back spring 8 is compressed and the back chuck 5 is advanced together with the lead tank 4. As the back chuck 5 is advanced, the chuck ring 6 comes into contact with a step formed in the inner surface of the coupling member 29 to release the chucking head of the back chuck 5, and then the lead is caused to drop by gravity into the front chuck 12. Then, the push cap 3 is released to enable the back chuck 5 to return to its initial position. When the push cap 3 is pushed repeatedly, the back chuck 5 gripping the lead is advanced in the coupling member 29 to feed the lead. Then, the lead advances through the front chuck 12 and is projected from the extremity of the barrel cap 2. When a portion of the lead projecting from the front chuck 12 wears out, the push cap 3 is pushed to feed the lead. When the lead wears short, the operation for pushing the push cap 3 is repeated to feed a new lead from the lead tank 4 and to push out the worn lead for continuous writing. If an excessively large length of the lead is extruded from the front end of the front chuck 12, the push cap 3 is pushed to open the chucking head of the back chuck 5, and the lead is pushed back into the front chuck 12 so that an appropriate length of the lead is projected from the tip of the front chuck 12 to prevent the breakage of the lead. When the lead is broken within the double-chuck mechanical pencil and the double-chuck mechanical pencil is jammed with the broke lead, the barrel cap 2 is removed from the barrel 1 by turning the same. Even if an effort is made to turn the elastic tube 28, the elastic tube 28 cannot be turned relative to the coupling member 29 because the detaining projections 28*f* of the elastic tube 28 are in engagement with the detaining openings 29*e* of the coupling member 29. Therefore, even if the lead is gripped by both the back chuck 5 and the front chuck 12, the lead is neither twisted nor broken. When the elastic tube 28 needs to be removed from the coupling member 29, the pair of detaining projections 28*f* are depressed radially and the elastic tube 28 is pulled backward to pull out the same from the coupling member 29.

Figure 14:
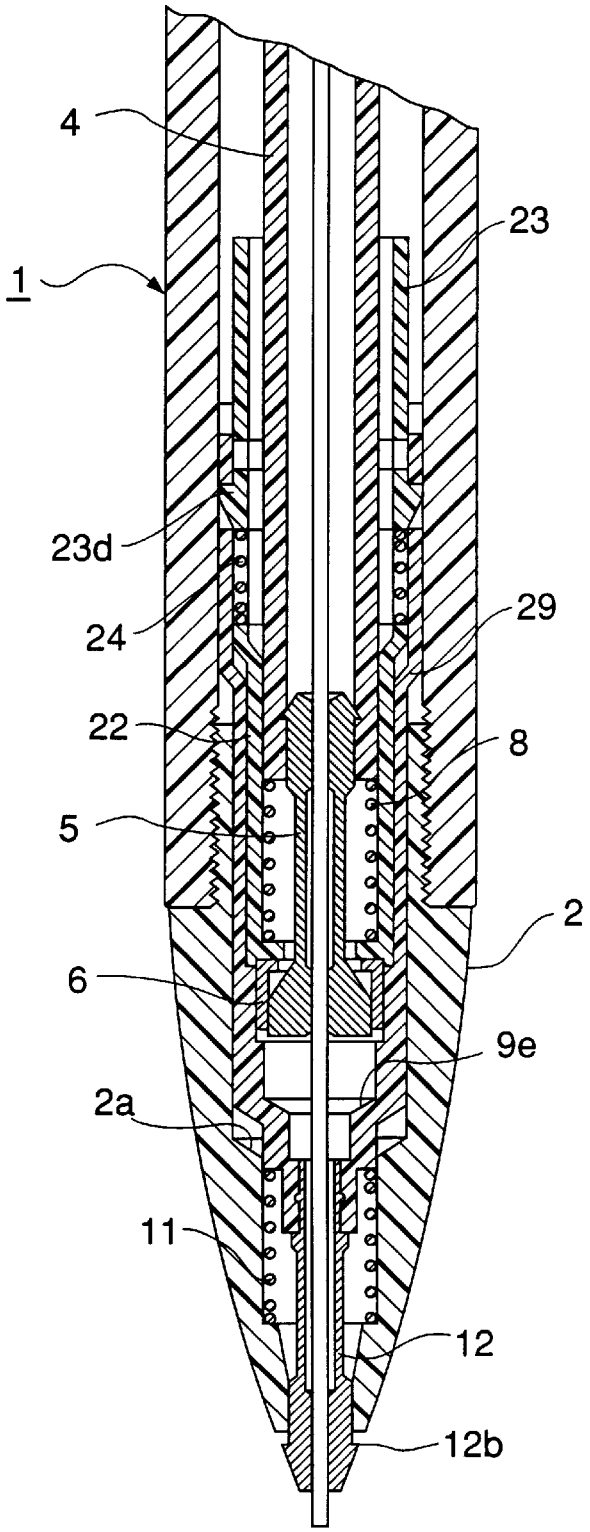
FIG. 14 is a fragmentary longitudinal sectional view of a modification of the double-chuck mechanical pencil of FIG. 9.

FIG. 14 shows a double-chuck mechanical pencil in a modification of the double-chuck mechanical pencil of FIG. 9. This double-chuck mechanical pencil is provided with a tubular structure comprising a front sleeve 22, a back stopping tube 23 and a spring 24 extended between front sleeve 22 and the back stopping tube 23 instead of the elastic tube 28 of the double-chuck mechanical pencil of FIG. 9. The elasticity of the spring 24 is far higher than that of the elastic tube 28. As shown in FIG. 14, the sleeve 22 is inserted in the front portion of a coupling member 29 similar to that shown in FIG. 9 in contact with the back end of a chuck ring 6. The detaining protrusions of the stopping tube 23 are in engagement with detaining openings 29*e* formed in the rear portion of the coupling member 29. A compression spring 24 is extended between the sleeve 22 and the stopping tube 23. The operation of this double-chuck mechanical pencil is the same as that of the double-chuck mechanical pencil of FIG. 9 and hence the description thereof will be omitted.

Figure 15:
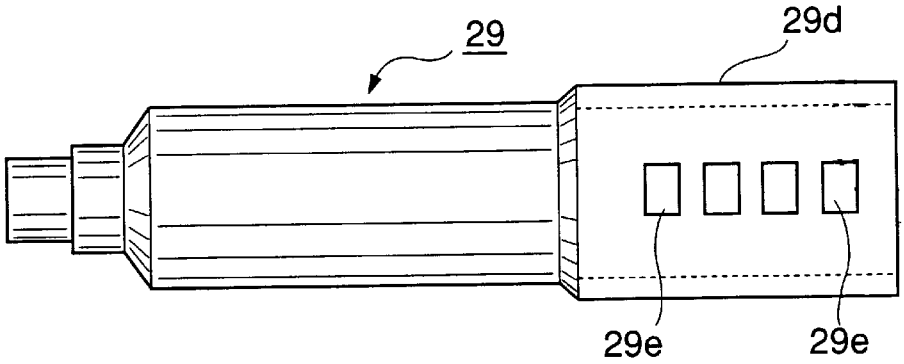
FIG. 15 is a front view of a modification of a coupling member included in the double-chuck mechanical pencil of FIG. 14.
Figure 16:
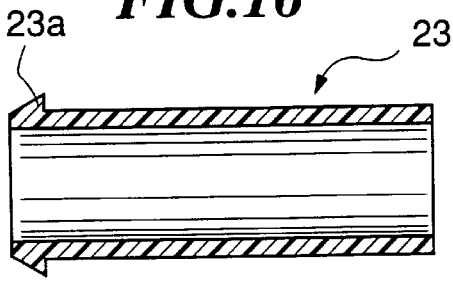
FIG. 16 is a longitudinal sectional view of a back tube to be used in combination with the coupling member of FIG. 15.

FIGS. 15 and 16 show a coupling member 29 and a stopping tube 23 in modifications of those employed in the double-chuck mechanical pencil of FIG. 14, respectively. As shown in FIG. 15, the coupling member 29 has an expanded section 29*d* provided with four detaining openings 29*e* formed at appropriate intervals in axial alignment. The detaining protrusion 23*a* of the stopping tube 23 is engaged selectively with one of the four detaining openings 29*e* depending on the desired resilience of the spring 24 interposed between the sleeve 22 and the stopping tube 23. For example, the detaining protrusion 23*a* and the foremost detaining opening 29*e* are engaged when the highest resilience of the spring 24 is necessary or the detaining protrusion 23*a* and the backmost detaining opening 29*e* are engaged when the lowest resilience of the spring 24 is necessary. The detaining protrusion 23*a* may have a triangular sectional shape as shown in FIG. 16.

Figure 17:
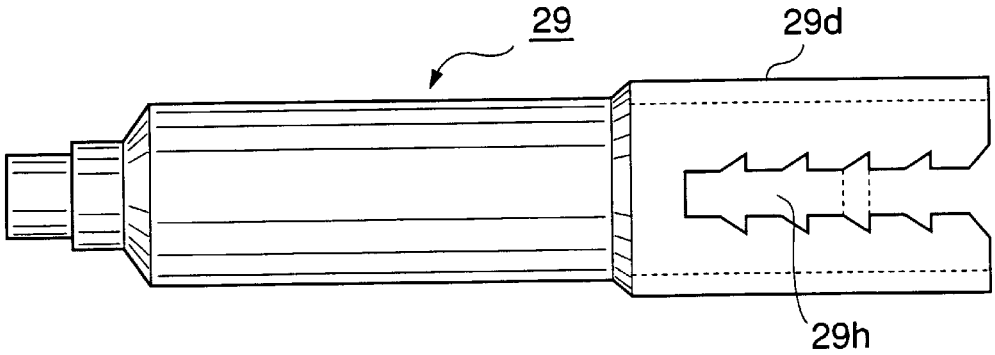
FIG. 17 is a front view of another modification of the coupling member of FIG. 14.
Figure 18:
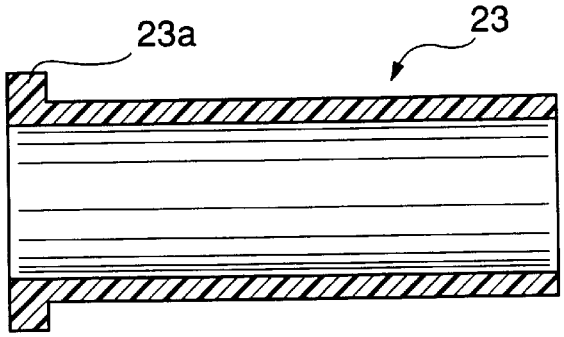
FIG. 18 is a longitudinal sectional view of a back tube to be used in combination with the coupling member of FIG. 17.

FIGS. 17 and 18 show a coupling member 29 and a stopping tube 23 in further modifications of those employed in the double-chuck mechanical pencil of FIG. 14, respectively. As shown in FIG. 17, the expanded section 29*d* of the coupling member 29 is provided with slits 29*h* defined by sawtooth edges. The sawtooth edges of the slits 29*h* enables the stepped adjustment of the resilience of the spring 24. The stopping tube 24 may be provided with detaining protrusions 23*a* having a rectangular sectional shape as shown in FIG. 18.

Figure 19:
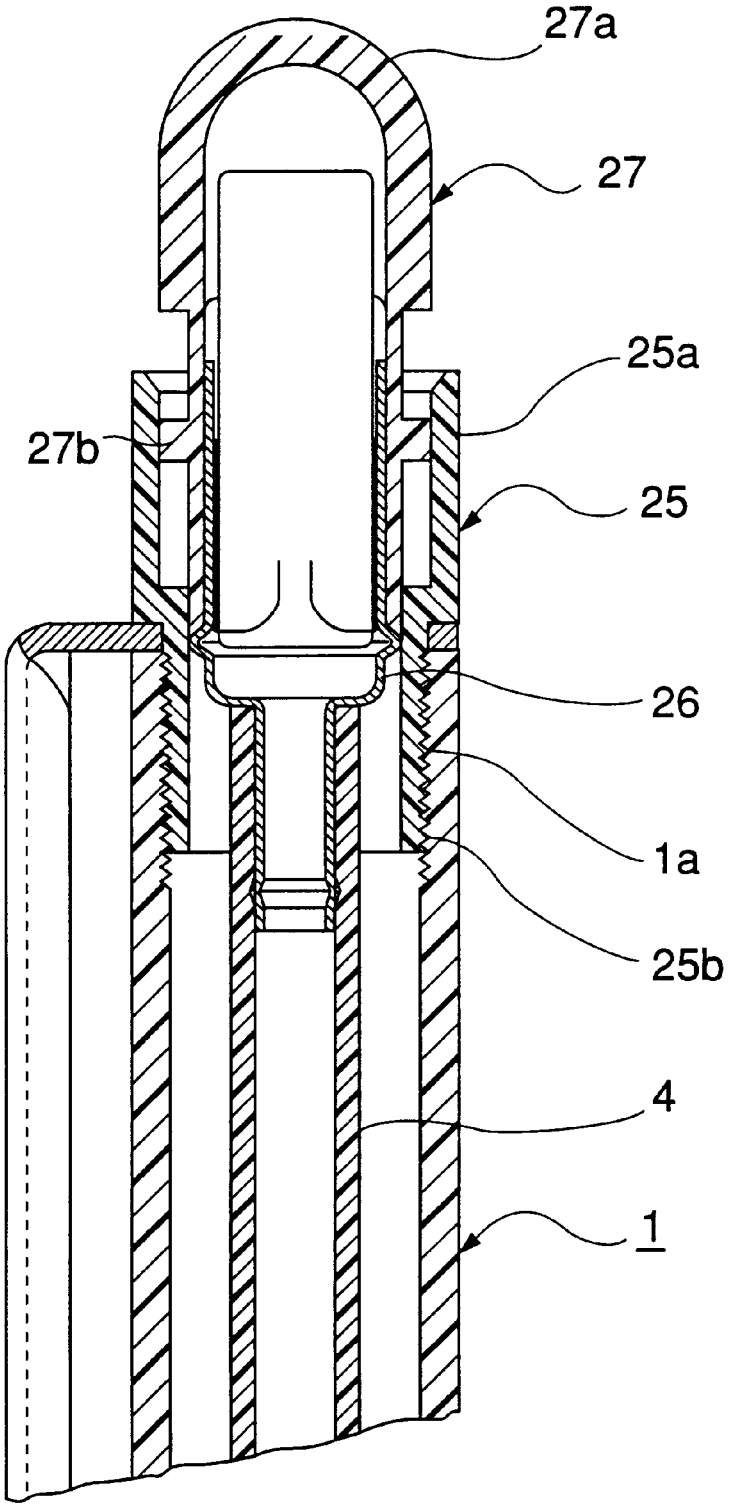
FIG. 19 is a fragmentary longitudinal sectional view of a double-chuck mechanical pencil in a fifth embodiment according to the present invention.
Figure 20:
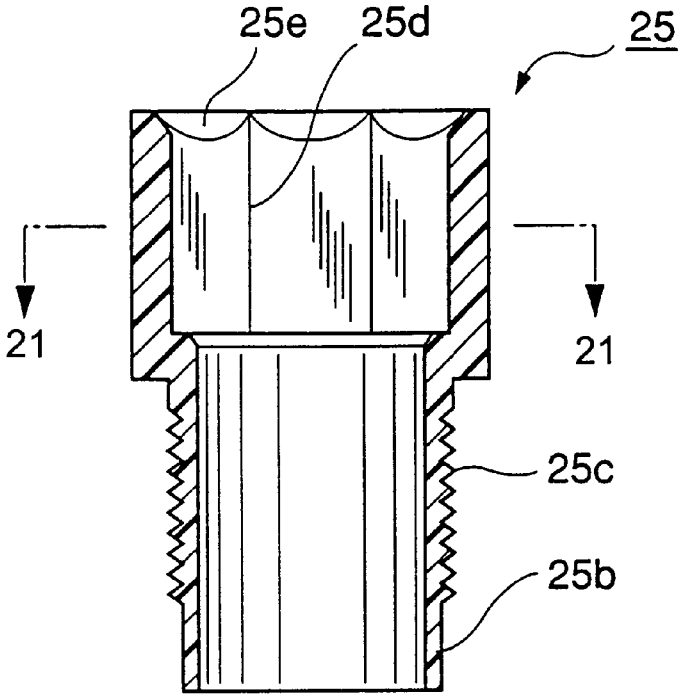
FIG. 20 is a longitudinal sectional view of a tail cap included in the double-chuck mechanical pencil of FIG. 19.
Figure 21:
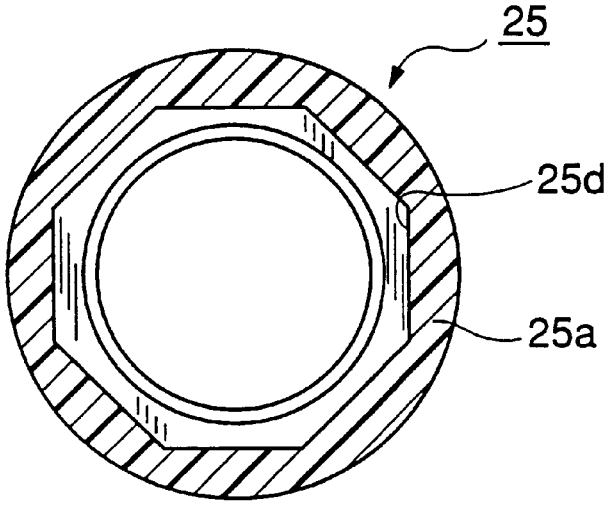
FIG. 21 is a sectional view taken on line B—B' in FIG. 20.
Figure 22:
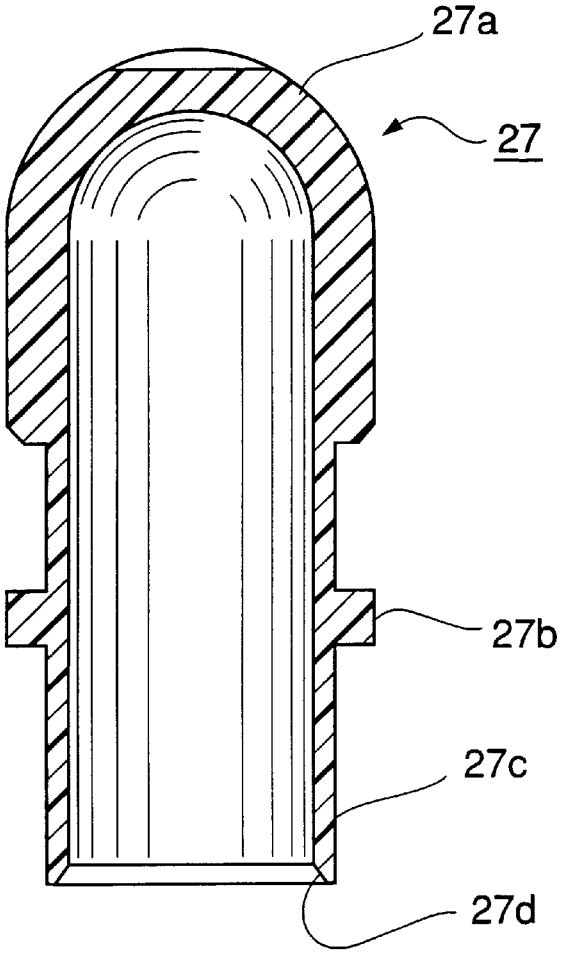
FIG. 22 is longitudinal sectional view of a push cap included in the double-chuck mechanical pencil of FIG. 19.
Figure 23:
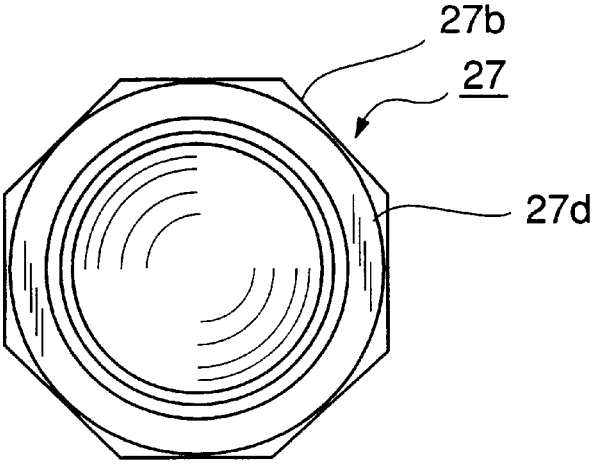
FIG. 23 is a bottom view of the push cap of FIG. 22.

FIG. 19 is a fragmentary longitudinal sectional view of a double-chuck mechanical pencil in a fifth embodiment according to the present invention, showing only the back portion of the double-chuck mechanical pencil. In this double-chuck mechanical pencil, a push cap is restrained from turning to prevent the breakage of the lead by twisting. A hollow tail cap 25 is fixedly screwed in the back end of a barrel 1. As shown in FIGS. 20 and 21, the tail cap 25 has a head section 25*a* projecting from the barrel 1, and a reduced section 25*b* provided with an external thread 25*c* that mates with an internal thread 1*a* formed in the inner circumference of the barrel 1. The head section 25*a* is provided with an octagonal hole 25*d*, and the edge of the octagonal hole 25*d* is chamfered in a beveled surface 25*e*. An eraser holder 26 holding an eraser is fitted in the back portion of a lead tank 4, and a push cap 27 is detachably put on the eraser holder 26. As shown in FIGS. 22 and 23, the push cap 27 has a semispherical head 27*a* and is provided with an octagonal flange 27*b* for stabilization below the head 27*a*. The octagonal flange 27*b* is fitted in the octagonal hole 25*d* of the head section 25*a* of the tail cap 25. Therefore, the push cap 27 is unable to turn relative to the tail cap 25 fixedly screwed in the back portion of the barrel 1, so that the lead tank 4 will not be turned and hence there is no possibility that the lead gripped by a back chuck 5 and a front chuck 12 is broken by twisting due to the turning of the back chuck 5 relative to the front chuck 12. The push cap 27 can be easily put on the eraser holder 26 simply by setting the octagonal flange 27*b* in alignment with the octagonal hole 25*d* of the tail cap 25, without requiring any troublesome step of determining the orientation of the push cap 27 relative to the tail cap 25 to fit, for example a rib formed in the push cap 27 in a groove formed in the tail cap 25. If the lower edge of the octagonal flange 27*b* is chambered to form a beveled surface 27*d* as shown in FIG. 23, the beveled surface 27*d* and the beveled surface 25*e* of the tail cap further facilitate assembling work. The lower portion 27*c* extending below the octagonal flange 27*b* of the push cap 27 may be formed in an octagonal shape, and an octagonal hole corresponding to the octagonal shape of the lower portion 27*c* of the push cap 27 may be formed in the reduced section 25*b* of the tail cap 25 for the same effect of restraining the push cap 27 from turning relative to the lead tank 4. Naturally, the push cap 27 may be provided with a flange or a lower portion of any suitable polygonal shape instead of the octagonal flange 27*b* or the octagonal lower portion 27*c*, and the tail cap 25 may be provided with a hole of a corresponding polygonal shape instead of the octagonal hole 25*d* or the octagonal hole of the reduced section 25*b*. A structure similar to this structure for restraining the push cap from turning relative to the lead tank can be incorporated into a double-chuck mechanical pencil not provided with any member corresponding to the tail cap 25, such as the double-chuck mechanical pencil of FIG. 9. When the incorporating the structure into the double-chuck mechanical pencil of FIG. 9, a polygonal hole may be formed in the back portion of the barrel 1, and a polygonal portion formed in the push cap 3 or the eraser holder 26 may be fitted in the polygonal hole of the barrel 1. When a polygonal portion is formed in the eraser holder 26 to restrain the push cap 3 from turning relative to the barrel 1 (FIG. 9) or the tail cap 25 (FIG. 19), the lead tank 4 does not turn together with the back chuck 5 to break the lead when the push cap 3 or 27 is removed.

Although the invention has been described in its preferred forms with a certain degree of particularity, obviously many changes and variations are possible therein. It is therefore to be understood that the present invention may be practiced otherwise than as specifically described herein without departing from the scope and spirit thereof.

Generally, the length of the residual lead that remains unavoidably in conventional single-chuck mechanical pencils with fixed tip pipe is in the range of about 10 to about 12 mm. Although the lead does not fall off while the lead is held by the frictional member for holding the lead after the lead has been released from the chuck, the lead turns to make the user feel a strange sensation. Then, the user is liable to judge from the strange sensation that the mechanical pencil is out of order instead of realizing that the lead has almost worn out. According to the present invention, the length of the residual lead is very small and hence the user will not make such a mistake.

The sliding tip pipe of a mechanical pencil with sliding tip pipe becomes unstable and wobbles upon the separation of the lead from the back chuck. Thus, the mechanical pencil with sliding tip pipe is more likely to make the user misjudge that the mechanical pencil is out of order than the mechanical pencil with fixed tip pipe.

According to the present invention, the coupling member and the barrel, the push cap, and the tail cap or the barrel, or the eraser holder and the barrel are restrained from turning relative to each other. Therefore, the lead will not be twisted and broken by the turning of those parts relative to each other, which improves the operability of the mechanical pencil.

What is claimed is:

1. A double-chuck mechanical pencil comprising:

a barrel;

a barrel cap threadedly attached to the barrel;

a lead tank axially slidably inserted in the barrel;

a back split chuck fixedly joined to a front end of the lead tank;

a chuck ring loosely fitted on a chucking head of the back split chuck;

an elastic tubular member which is connected to a coupling member, a front end of the lead tank being axially slidable in the tubular member;

a back biasing member positioned inside the tubular member and extending between a front end of the tubular member and the front end of the lead tank so as to bias the lead tank backward;

the coupling member directly connected in rotationally fixed relation with the tubular member in a manner which permits extension and contraction of the tubular member, said coupling member being provided in its inner circumference with stopping portions with which the tubular member and the chuck ring come into contact;

a front split chuck fixedly joined to a front portion of the coupling member;

a front biasing member positioned inside the barrel cap and extending between the barrel cap and the coupling member so as to bias the coupling member backward, the resilience of the front biasing member being lower than that of the back biasing member; and rotation prohibiting means for restraining the tubular member and the coupling member from turning relative to each other, said rotation prohibiting means comprising detaining protrusions formed in the tubular member and detaining openings formed in the coupling member so as to be engaged with the detaining protrusions of the tubular member;

wherein the rotationally fixed relation of the coupling member and the tubular member prevent lead-breaking rotation of the front split chuck relative to the back split chuck.

2. A double-chuck mechanical pencil according to claim 1, wherein the tubular member is integrally provided with axially extendible and contractible elastic means.

3. A double-chuck mechanical pencil according to claim 1, wherein the front split chuck is combined with the barrel cap and is formed so as to grip the lead lightly to prohibit unrestrained movement of the lead and to allow axial movement of the lead when an axial force acts on the lead when the front split chuck is at its advanced position, and to grip the lead firmly so that the lead is not pushed back by writing pressure acting on the lead during writing when the front split chuck is at its retracted position.

4. A double-chuck mechanical pencil comprising:

a barrel;

a barrel cap threadedly attached to the barrel;

a lead tank axially slidably inserted in the barrel;

a back split chuck fixedly joined to a front end of the lead tank;

a chuck ring loosely fitted on a chucking head of the back split chuck;

an elastic tubular member which is connected to a coupling member, a front end of the lead tank being axially slidable in the tubular member;

a back biasing member positioned inside the tubular member and extending between a front end of the tubular member and the front end of the lead tank so as to bias the lead tank backward;

the coupling member directly connected in rotationally fixed relation with the tubular member in a manner which permits extension and contraction of the tubular member, said coupling member being provided in its inner circumference with stopping portions with which the tubular member and the chuck ring come into contact;

a front split chuck fixedly joined to a front portion of the coupling member; and a front biasing member positioned inside the barrel cap and extending between the barrel cap and the coupling member so as to bias the coupling member backward, the resilience of the front biasing member being lower than that of the back biasing member;

the front split chuck being combined with the barrel cap and being formed so as to grip the lead lightly to prohibit unrestrained movement of the lead and to allow axial movement of the lead when an axial force acts on the lead when the front split chuck is at its advanced position, and to grip the lead firmly so that the lead is not pushed back by writing pressure acting on the lead during writing when the front split chuck is at its retracted position;

wherein the rotationally fixed relation of the coupling member and the tubular member prevent lead-breaking rotation of the front split chuck relative to the back split chuck.

* * * * *